US006902008B2

(12) United States Patent
Hirth et al.

(10) Patent No.: US 6,902,008 B2
(45) Date of Patent: Jun. 7, 2005

(54) BI-DIRECTIONALLY BOOSTING AND INTERNAL PRESSURE TRAPPING PACKING ELEMENT SYSTEM

(75) Inventors: David E. Hirth, Pasadena, TX (US); Gerald D. Pedersen, Houston, TX (US); Tarald Gudmestad, Houston, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 10/317,013

(22) Filed: Dec. 11, 2002

(65) Prior Publication Data

US 2003/0132008 A1 Jul. 17, 2003

Related U.S. Application Data

(60) Provisional application No. 60/340,520, filed on Dec. 12, 2001.

(51) Int. Cl.[7] ..... E21B 33/128; E21B 33/12

(52) U.S. Cl. ..... 166/387; 166/122; 166/187; 166/212; 277/338

(58) Field of Search ..... 166/381, 387, 166/373, 374, 118, 119, 120, 122, 187, 195, 206, 212, 196; 277/322, 336, 337, 338

(56) References Cited

U.S. PATENT DOCUMENTS

| | | | | |
|---|---|---|---|---|
| 2,182,251 A | * 12/1939 | Crickmer et al. | ..... | 166/183 |
| 2,222,014 A | * 11/1940 | Baker | ..... | 277/333 |
| 2,306,160 A | 12/1942 | Freyssinet | ..... | 288/6 |
| 2,519,116 A | 8/1950 | Crake | ..... | 166/10 |
| 2,656,891 A | 10/1953 | Toelke | ..... | 166/13 |
| 2,751,017 A | 6/1956 | Baker et al. | ..... | 166/216 |
| 2,814,517 A | 11/1957 | Razdow | ..... | 288/20 |
| 2,988,148 A | * 6/1961 | Conrad et al. | ..... | 277/337 |
| 3,002,561 A | * 10/1961 | Baker et al. | ..... | 166/120 |
| 3,054,450 A | 9/1962 | Baker | ..... | 166/120 |
| 3,061,013 A | 10/1962 | Thomas, Jr. | ..... | 166/204 |
| 3,147,016 A | 9/1964 | Traufler | ..... | 277/226 |
| 3,298,440 A | 1/1967 | Current | ..... | 166/123 |

(Continued)

FOREIGN PATENT DOCUMENTS

| | | | | |
|---|---|---|---|---|
| EP | 0 237 662 A1 | 9/1987 | ..... | E21B/34/10 |
| EP | 0 959 226 A2 | 11/1999 | ..... | E21B/33/12 |
| FR | 2 377 518 | 8/1978 | ..... | E21B/33/128 |
| FR | 2 586 781 | 6/1987 | ..... | F16J/15/34 |
| GB | 1 398 038 | 6/1975 | ..... | E21B/33/128 |

OTHER PUBLICATIONS

PCT International Search Report, International Application No. PCT/GB 02/05576, dated Mar. 28, 2003.

*Primary Examiner*—David Bagnell
*Assistant Examiner*—Jennifer H Gay
(74) *Attorney, Agent, or Firm*—Moser, Patterson & Sheridan, L.L.P.

(57) ABSTRACT

Present invention is a packer for sealing an annular region in a wellbore. The packer includes a packing element which is held through bi-directional forces. The packer first comprises an inner mandrel. Disposed around the inner mandrel are three tubulars: (1) a top sleeve; (2) a bottom sleeve; and (3) a booster sleeve. A packing element is disposed circumferentially around the outer surface of the booster sleeve. The top sleeve and bottom sleeve each include an upper compression member which rides across the booster sleeve in order to compress the packing element. The packing element is expanded outward from the packer to engage a surrounding string of casing through compressive forces provided by the top and bottom sleeves. Thereafter, differential pressure applied above or below the packer acting on the packer element and booster sleeve may provide additional compression of the packer element.

49 Claims, 12 Drawing Sheets

U.S. PATENT DOCUMENTS 3,339,637 A * 9/1967 Holden ..... 166/128
3,374,840 A * 3/1968 Current ..... 166/134
3,412,802 A * 11/1968 Kisling, III ..... 166/120
3,459,261 A * 8/1969 Cochran ..... 166/120
3,467,184 A * 9/1969 Young ..... 166/129
3,507,327 A 4/1970 Chenoweth ..... 166/134
3,623,551 A 11/1971 Randermann, Jr. ..... 166/134
3,678,998 A 7/1972 Cockrell et al. ..... 166/123
3,690,375 A 9/1972 Shillander ..... 166/187
3,976,133 A * 8/1976 Allen ..... 166/120
4,018,274 A * 4/1977 Cochran ..... 166/129
4,078,606 A 3/1978 Montgomery ..... 166/120
4,146,093 A 3/1979 Horvath et al. ..... 166/120
4,153,109 A 5/1979 Szescila ..... 166/250
4,216,827 A * 8/1980 Crowe ..... 166/120
4,224,987 A 9/1980 Allen ..... 166/120
4,253,676 A 3/1981 Baker et al. ..... 277/34.6
4,289,200 A 9/1981 Fisher, Jr. ..... 166/120
4,300,775 A 11/1981 Ringel ..... 277/34.3
4,345,649 A 8/1982 Baugh et al. ..... 166/120
4,353,420 A 10/1982 Miller ..... 166/382
4,375,240 A 3/1983 Baugh et al. ..... 166/387
4,403,660 A 9/1983 Coone ..... 166/387
4,406,469 A 9/1983 Allison ..... 277/123
4,436,150 A 3/1984 Barker ..... 166/131
4,444,252 A * 4/1984 Fisher, Jr. ..... 166/134
4,452,463 A 6/1984 Buckner ..... 277/120
4,457,369 A 7/1984 Henderson ..... 166/125
4,487,258 A 12/1984 Jackson et al. ..... 166/120
4,499,947 A 2/1985 Zsoka et al. ..... 166/179
4,537,251 A * 8/1985 Braddick ..... 166/196
4,540,047 A 9/1985 Akkerman ..... 166/188
4,573,537 A 3/1986 Hirasuna et al. ..... 166/387
4,601,498 A 7/1986 Haugen ..... 285/332.3
4,640,351 A 2/1987 Clifton et al. ..... 166/127
4,662,450 A 5/1987 Haugen ..... 166/299
4,674,570 A 6/1987 Jackson ..... 166/187
4,708,202 A 11/1987 Sukup et al. ..... 166/123
4,730,670 A 3/1988 Kim ..... 166/134
4,749,035 A 6/1988 Cassity ..... 166/120
4,753,444 A 6/1988 Jackson et al. ..... 277/230
4,762,179 A 8/1988 Wesson et al. ..... 166/297
4,784,226 A 11/1988 Wyatt ..... 166/376
4,834,175 A 5/1989 Ross et al. ..... 166/120
4,886,117 A 12/1989 Patel ..... 166/187
4,898,239 A 2/1990 Rosenthal ..... 166/133
4,907,651 A 3/1990 Bou-Mikael ..... 166/114
4,913,232 A 4/1990 Cheymol et al. ..... 166/285
5,044,441 A 9/1991 Rubbo et al. ..... 166/382
5,103,901 A * 4/1992 Greenlee ..... 166/120
5,165,703 A 11/1992 Morvant ..... 277/188
5,226,492 A 7/1993 Solaeche et al. ..... 166/196
5,271,469 A 12/1993 Brooks et al. ..... 166/387
5,309,993 A 5/1994 Coon et al. ..... 166/115
5,311,938 A 5/1994 Hendrickson et al. ..... 166/134
5,332,038 A 7/1994 Tapp et al. ..... 166/278
5,433,269 A 7/1995 Hendrickson ..... 166/134
5,511,620 A 4/1996 Baugh et al. ..... 166/387
5,542,473 A 8/1996 Pringle et al. ..... 166/120
5,605,195 A 2/1997 Eslinger et al. ..... 166/387
5,620,050 A 4/1997 Barbee ..... 166/278
5,636,689 A 6/1997 Rubbo et al. ..... 166/123
5,676,384 A 10/1997 Culpepper ..... 277/188
5,678,635 A 10/1997 Dunlap et al. ..... 166/387
5,711,372 A 1/1998 Stokley ..... 166/187
5,749,585 A 5/1998 Lembcke ..... 277/116.2
5,775,429 A 7/1998 Arizmendi et al. ..... 166/387
5,787,987 A 8/1998 Forsyth et al. ..... 166/313
5,803,178 A 9/1998 Cain ..... 166/306
5,810,082 A 9/1998 Jordan, Jr. ..... 166/120
5,819,846 A 10/1998 Bolt, Jr. ..... 166/123
5,819,854 A * 10/1998 Doane et al. ..... 166/373
5,833,001 A 11/1998 Song et al. ..... 166/287
5,875,841 A 3/1999 Wright et al. ..... 166/85.4
5,875,847 A 3/1999 Forsyth ..... 166/313
5,941,313 A 8/1999 Arizmendi ..... 166/387
6,009,951 A 1/2000 Coronado et al. ..... 166/387
6,041,858 A 3/2000 Arizmendi ..... 166/187
6,102,117 A 8/2000 Swor et al. ..... 166/138
6,116,339 A 9/2000 Milne et al. ..... 166/125
6,244,642 B1 6/2001 Serafin et al. ..... 294/86.17
6,318,461 B1 11/2001 Carisella ..... 166/196

* cited by examiner

BI-DIRECTIONALLY BOOSTING AND INTERNAL PRESSURE TRAPPING PACKING ELEMENT SYSTEM

CROSS-REFERENCE TO RELATED APPLICATIONS

This application claims benefit of U.S. provisional patent application Ser. No. 60/340,520, filed Dec. 12, 2001, which is herein incorporated by reference.

BACKGROUND OF THE INVENTION

1. Field of the Invention

The present invention generally relates to completion operations in a wellbore. More particularly, the invention relates to a packer for sealing an annular area between two tubular members within a wellbore. More particularly still, the invention relates to a packer having a bi-directionally boosted and held packing element.

2. Description of the Related Art

In the drilling of oil and gas wells, a wellbore is formed using a drill bit that is urged downwardly at a lower end of a drill string. After drilling a predetermined depth, the drill string and bit are removed and the wellbore is lined with a string of casing. An annular area is thus formed between the string of casing and the formation. A cementing operation is then conducted in order to fill the annular area with cement. The combination of cement and casing strengthens the wellbore and facilitates the isolation of certain areas of the formation behind the casing for the production of hydrocarbons.

It is common to employ more than one string of casing in a wellbore. In this respect, a first string of casing is set in the wellbore when the well is drilled to a first designated depth. The first string of casing is hung from the surface, and then cement is circulated into the annulus behind the casing. The well is then drilled to a second designated depth, and a second string of casing, or liner, is run into the well. The second string is set at a depth such that the upper portion of the second string of casing overlaps with the lower portion of the upper string of casing. The second "liner" string is then fixed or "hung" off of the upper surface casing. Afterwards, the liner is also cemented. This process is typically repeated with additional liner strings until the well has been drilled to total depth. In this manner, wells are typically formed with two or more strings of casing of an ever-decreasing diameter.

The process of hanging a liner off of a string of surface casing or other upper casing string involves the use of a liner hanger. In practice, the liner hanger is run into the wellbore above the liner string itself. The liner hanger is actuated once the liner is set at the appropriate depth within the wellbore. The liner hanger is typically set through actuation of slips which ride outwardly on cones in order to frictionally engage the surrounding string of casing. The liner hanger operates to suspend the liner from the casing string. However, it does not provide a fluid seal between the liner and the casing. Accordingly, it is desirable in many wellbore completions to also provide a packer.

During the wellbore completion process, the packer is run into the wellbore above the liner hanger. A threaded connection typically connects the bottom of the packer to the top of the liner hanger. Known packers employ a mechanical or hydraulic force in order to expand a packing element outwardly from the body of the packer into the annular region defined between the packer and the surrounding casing string. In addition, a cone is driven behind a tapered slip to force the slip into the surrounding casing wall and to prevent packer movement. Numerous arrangements have been derived in order to accomplish these results.

A disadvantage with known packer systems is the potential for becoming unseated. In this regard, wellbore pressures existing within the annular region between the liner and the casing string act against the setting mechanisms, creating the potential for at least partial unseating of the packing element. Generally, the slip is used to prevent packer movement also traps into the packer element the force used to expand the packer element. The trapped force provides the packer element with an internal pressure. During well operations, a differential pressure applied across the packing element may fluctuate due to changes in formation pressure or operation pressures in the wellbore. When the differential pressure approaches or exceeds the initial internal pressure of the packer element, the packing element is compressed further by the differential pressure, thereby causing it to extrude into smaller voids and gaps. Thereafter, when the pressure is decreased, the packing element begins to relax. However, the internal pressure of the packer element is now below the initial level because of the volume transfer during extrusion. The reduction in internal pressure decreases the packer element's ability to maintain a seal with the wellbore when a subsequent differential pressure is applied.

Therefore, there is a need for a packer system in which the packing element does not disengage from the surrounding casing under exposure to formation pressure. In addition, a packer system is needed in which the presence of formation pressure only serves to further compress the packing element into the annular region, thereby assuring that formation pressure will not unseat the seating element. Further still, a packer system is needed to maintain the internal pressure at a higher level than the differential pressures across the packer element. Further still, a packer system is needed to boost the internal pressure of the packer element above the differential pressure across the packer element. Further still, a packer system is needed that can boost the internal pressure of the packer element with equal effectiveness from differential pressure above or below the packer element.

SUMMARY OF THE INVENTION

The present invention provides a packer assembly for use in sealing an annular region between tubulars in a wellbore. The packer of the present invention first provides a mandrel. The mandrel defines a tubular body having a bore therein. The bore serves to provide fluid communication between the working string and the downhole liner for wellbore completion operations.

On the outer surface of the mandrel is a series of sleeves. A top sleeve, a bottom sleeve, and a booster sleeve are provided. Each sleeve also defines a tubular member that is slidable axially along the outer surface of the mandrel. As implied by the naming, the top sleeve is positioned above the booster sleeve, while the bottom sleeve is positioned below the booster sleeve.

The packer of the present invention also includes a packing element. The packing element is disposed around the outer surface of the booster sleeve. The packing element is expanded radially outward from the booster sleeve and into engagement with a surrounding string of casing by compressive forces. The compressive forces originate from a downward force applied to the top sleeve, pressure above the booster sleeve, or pressure below the booster sleeve. The downward force may come from applying the weight of the landing string above the packer.

A novel feature for the packer of the present invention includes a pair of ratchet rings disposed on the outer surface of the booster sleeve. An upper ratchet ring is placed above the packing element, while a lower ratchet ring is disposed below the packing element. The upper ratchet ring is connected to the top sleeve and rides downward along the outer surface of the booster sleeve when the top sleeve is urged downwardly, or the booster sleeve is urged upwardly. Reciprocally, the lower ratchet ring is connected to the bottom sleeve, and rides upwardly along the outer surface of the booster sleeve in response to downward movement of the booster sleeve. Each ratchet ring is configured to ride across serrations on the outer surface of the booster sleeve. In this way, the ratchet rings lock in the relative positions of the top sleeve and the bottom sleeve as they travel across the booster sleeve. These locked positions, in turn, effectuate a more effective holding of the packing element within the annular region.

Finally, the packer of the present invention may provide slips and associated cones for holding the position of the packer within the casing. In one arrangement, the slips, cones and top sleeve are initially held together by a frangible member such that downward force on the slip ring supplies the needed downward force on the top sleeve in order to expand the packing element from the packer assembly.

BRIEF DESCRIPTION OF THE DRAWINGS

So that the manner in which the above recited features of the present invention are attained and can be understood in detail, a more particular description of the invention, briefly summarized above, may be had by reference to the embodiments thereof which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1A:
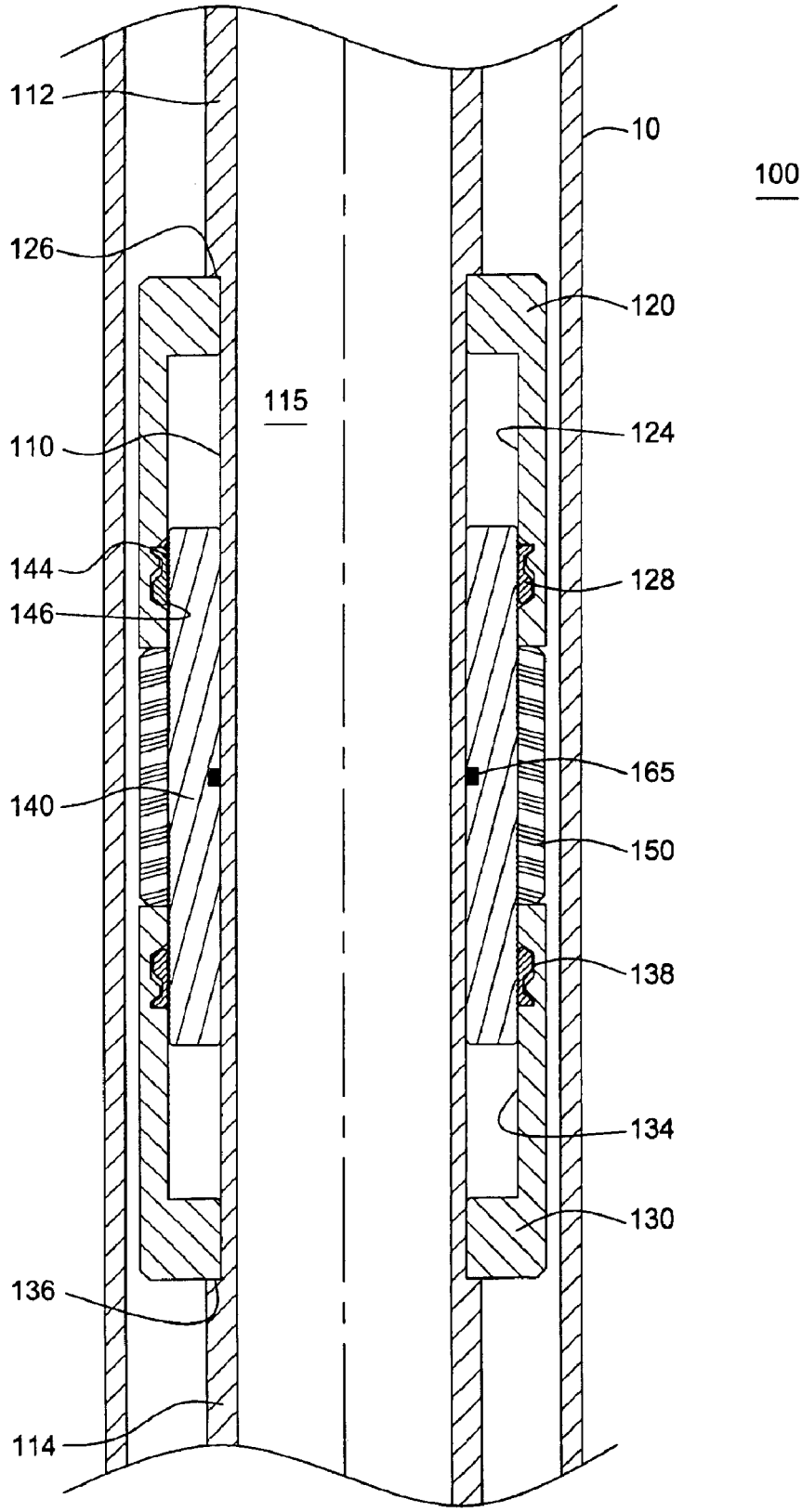
FIG. 1A presents a partial cross-sectional view of a packer assembly in accordance to one embodiment of the present invention in the unactuated position.

FIG. 1A presents a cross-sectional view of a packer assembly 100 in accordance with the present invention. The packer 100 has been run into a wellbore (not shown). The packer 100 has been positioned inside a string of casing 10. The packer 100 is designed to be actuated such that a seal is created between the packer 100 and the surrounding casing string 10.

The packer 100 is run into the wellbore at the upper end of a liner string or other tubular (not shown). Generally, the bottom end of the packer 100 is threadedly connected to a liner hanger (not shown). Those of ordinary skill in the art will understand that the liner hanger is also actuated in order to engage the surrounding upper string of casing 10 and, thereby anchoring the liner below. In this manner, a liner string (not shown) may be suspended from the upper casing string 10.

In the typical well completion operation, the packer 100 is run into the wellbore along with various other completion tools. For example, a polished bore receptacle (not shown) may be utilized at the top of a liner string. The top end of the packer 100 may be threadedly connected to the lower end of a polished bore receptacle, or PBR. The PBR permits the operator to sealingly stab into the liner string with other tools. Commonly, the PBR is used to later tie back to the surface with a string of production tubing. In this way, production fluids can be produced through the liner string, and upward to the surface.

Tools for conducting cementing operations are also commonly run into the wellbore along with the packer 100. For example, a cement wiper plug (not shown) will be run into the wellbore along with other run-in tools. The liner string will typically be cemented into the formation as part of the completion operation.

The liner, liner hanger, PBR, and the packer 100 are run into the wellbore together on a landing string (not shown). A float nut (not shown) is commonly used to connect the landing string to the liner and associated completion tools so that the packer 100 and connected liner can be run into the wellbore together. The float nut is landed into a float nut profile positioned at the upper end of the packer 100 for run-in.

Shown in FIG. 1A is a packer 100 of the present invention comprising a mandrel 110. The mandrel 110 defines a tubular body that runs the length of the packer tool 100. As such, the mandrel 110 has a bore 115 therein which serves to provide fluid communication between the landing string and the liner. This facilitates the injection and circulation of fluids during various wellbore completion and production procedures.

The mandrel 110 has a top end 112 and a bottom end 114. Generally, the top end 112 of the mandrel 110 is connected to a landing string (not shown). At the lower end 114, the mandrel 110 is connected to the liner (not shown), either directly or through an intermediate connection with the liner hanger (not shown).

Various sleeve members are disposed on an outer surface of the mandrel 110. These represent (1) a top sleeve 120, (2) a bottom sleeve 130, and (3) an intermediate booster sleeve 140. Each of these sleeves 120, 130, 140 defines a tubular body, which is coaxially slidable along the outer surface of mandrel 110. As the name indicates, the top sleeve 120 is disposed on the mandrel 110 proximate to the upper end 112. Similarly, the bottom sleeve 130 is disposed on the outer surface of the mandrel 110 proximate to the bottom end 114. The booster sleeve 140 resides intermediate to the top sleeve 120 and the bottom sleeve 130. The sleeves 120, 130, 140 are contained between shoulders 126, 136 formed in the outer surface of the mandrel 110.

Each of the top sleeve 120 and the bottom sleeve 130 has ratchet rings 128, 138 to limit the movement of the sleeves 120, 130 relative to the booster sleeve 140. First, a ratchet ring 128 disposed underneath the extension portion 124 of the top sleeve 120 is positioned on the outer surface of the booster sleeve 140. Second, a ratchet ring 138 disposed underneath the extension portion 134 of the bottom sleeve 130 is positioned on the outer surface of the booster sleeve 140. Preferably, the ratchet rings 128, 138 each define a C-shaped circumferential ring around the outer surface of the booster sleeve 140. Each ratchet ring 128, 138 includes serrations 144 that ride upon teeth 146 on the outer surface of the booster sleeve 140. The ratchet rings 128,138 are designed to provide one-way movement of the top and bottom sleeves 120, 130 with respect to the booster sleeve 140. Specifically, the ratchet rings 128, 138 are arranged so that the top and bottom sleeves 120, 130 may only move inward towards the middle of the booster sleeve 140. In this way, the top sleeve 120 and bottom sleeve 130 each become locked into position as they advance across the outer surface of the booster sleeve 140 towards the packing element 150.

A packing element 150 resides circumferentially around the outer surface of the booster sleeve 140. The inner surface of the booster sleeve 140 is sealingly engaged with the mandrel 110 by seal 165. As will be disclosed below, the packing element 150 is expanded into contact with the surrounding casing 10 in response to compressive forces generated by the top sleeve 120 and the bottom sleeve 130. In this way, the annular region between the packer 100 and the casing 10 is fluidly sealed.

The packer 100 of the present invention is set through mechanical forces, hydraulic forces, or combinations thereof. The mechanical force to be applied on the packer 100 for setting may be derived from the landing string. In operation, the liner and associated completion tools, including the packer 100, are positioned within the wellbore. The liner is then set through actuation of the liner hanger and the running tool is released, but left in place. Thereafter, the cement wiper plug is released and cementing operations for the liner are conducted. After a proper volume of cement slurry has been circulated into the annular region behind the liner, the landing string is then pulled up a distance within the wellbore. Spring-loaded dogs (not shown) positioned in the landing string are raised within the wellbore so as to clear the top of the PBR, whereupon the dogs spring outward. The landing string then uses the dogs in order to land on top of the PBR, and to exert the force needed to begin actuation of the packer 100. In this regard, the suspended weight of the landing string is slacked off from the surface so as to apply gravitational force downward on the PBR and, in turn, the top sleeve 120 of the packer 100.

Figure 1B:
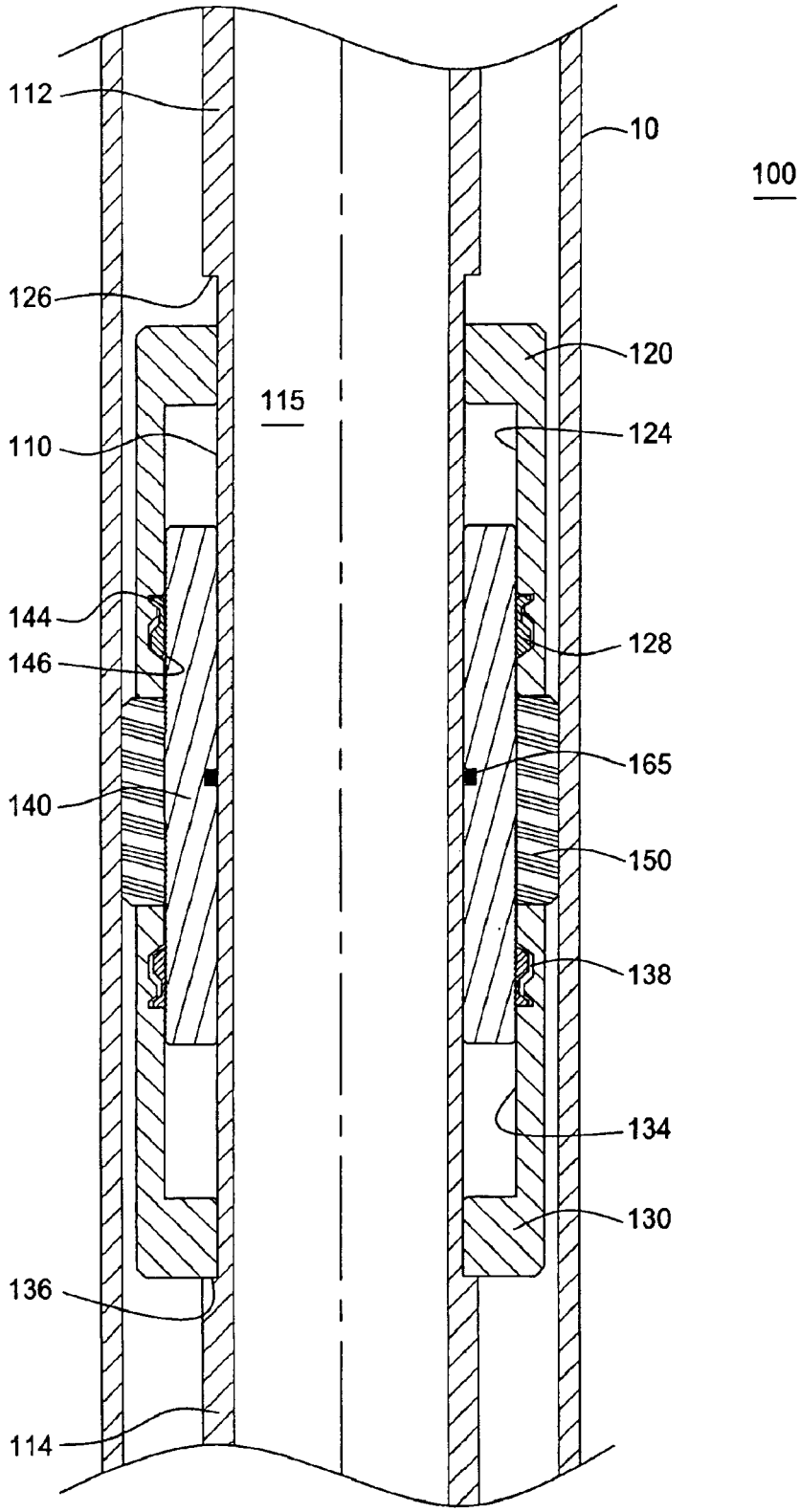
FIG. 1B presents the packer assembly in FIG. 1A in the actuated position.

The packer 100 is constructed and arranged in order to transmit downward force through the top sleeve 120. With the mandrel 110 held stationary, setting force is applied to cause the top sleeve 120 to travel downward with respect to the mandrel 110. As shown in FIG. 1B, this moves the top sleeve 120 closer to the bottom sleeve 130, thereby compressing the packer element 150. In turn, the packer element 150 begins to expand radially to form a seal with the casing 10. The setting force creates an initial internal pressure in the packer element 150. As the top sleeve 120 moves towards the packing element 150, the ratchet ring 128 of the top sleeve 120 also moves along the booster sleeve 140 and prevents the top sleeve 120 from reversing directions. Consequently, the ratchet rings 128 and 138 help to maintain the internal pressure in the packer element 150.

After the packer element 150 is set, various forces may act on the packer 100 during the operation of the wellbore. For example, when pressure is applied from above, it acts across the booster sleeve 140 and the packer element 150. The downward force applied to the booster sleeve 140 is transferred to the top sleeve 120 through the one-way ratchet ring 128. Because the packer element 150 is held stationary on the lower end by the bottom sleeve 130 resting against the lower shoulder 136, the downward force from the top sleeve 120 causes the packer element 150 to compress further. As the packer element 150 compresses the booster sleeve 140 travels downward under the bottom sleeve 130. The ratchet ring 138 in the bottom sleeve 130 locks in this movement and maintains a high level of internal pressure even after the applied pressure is reduced as shown in FIG. 1B.

Figure 1C:
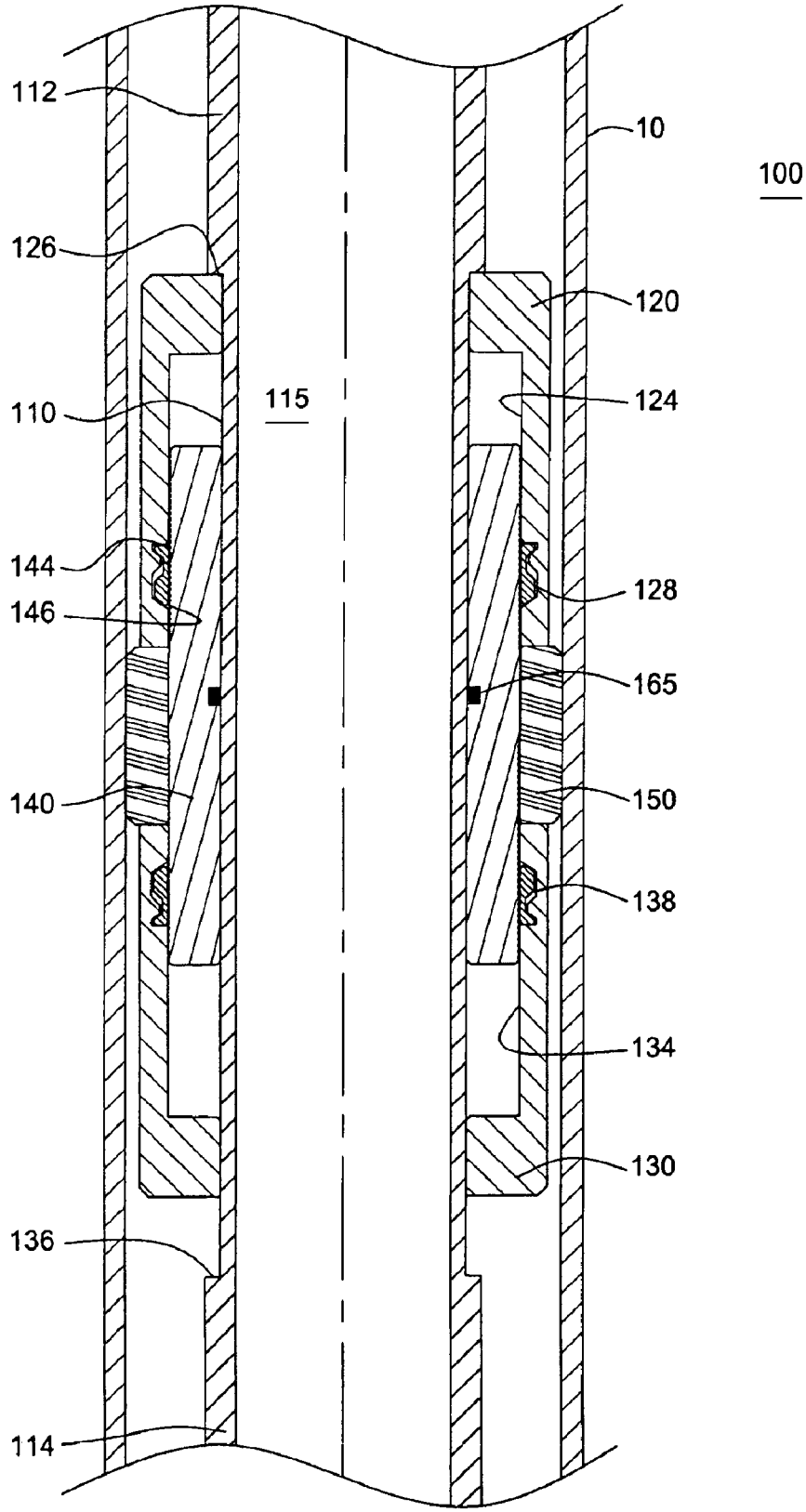
FIG. 1C presents the packer assembly in FIG. 1B after a pressure is applied from below.

FIG. 1C shows the packer 100 after pressure is applied from below and acts on the booster sleeve 140 and the packer element 150. Pressure from below is transferred from the booster sleeve 140 to the bottom sleeve 130 through the ratchet ring 138 of the bottom sleeve 130. In turn, the bottom sleeve 130 exerts force on the packer element 150. Under pressure, the sleeves 120, 130, 140 move relative to the mandrel 110 and the casing 10 until the top sleeve 120 contacts the upper shoulder 126 of the mandrel 110. Once stationary, the packer element 150 begins to compress under force from the bottom sleeve 130. As the packer element 150 compresses, the booster sleeve 140 travels upward under the top sleeve 120. The ratchet ring 128 of the top sleeve 120 locks in the movement and maintains the internal pressure even after the applied pressure is reduced.

Figure 2A:
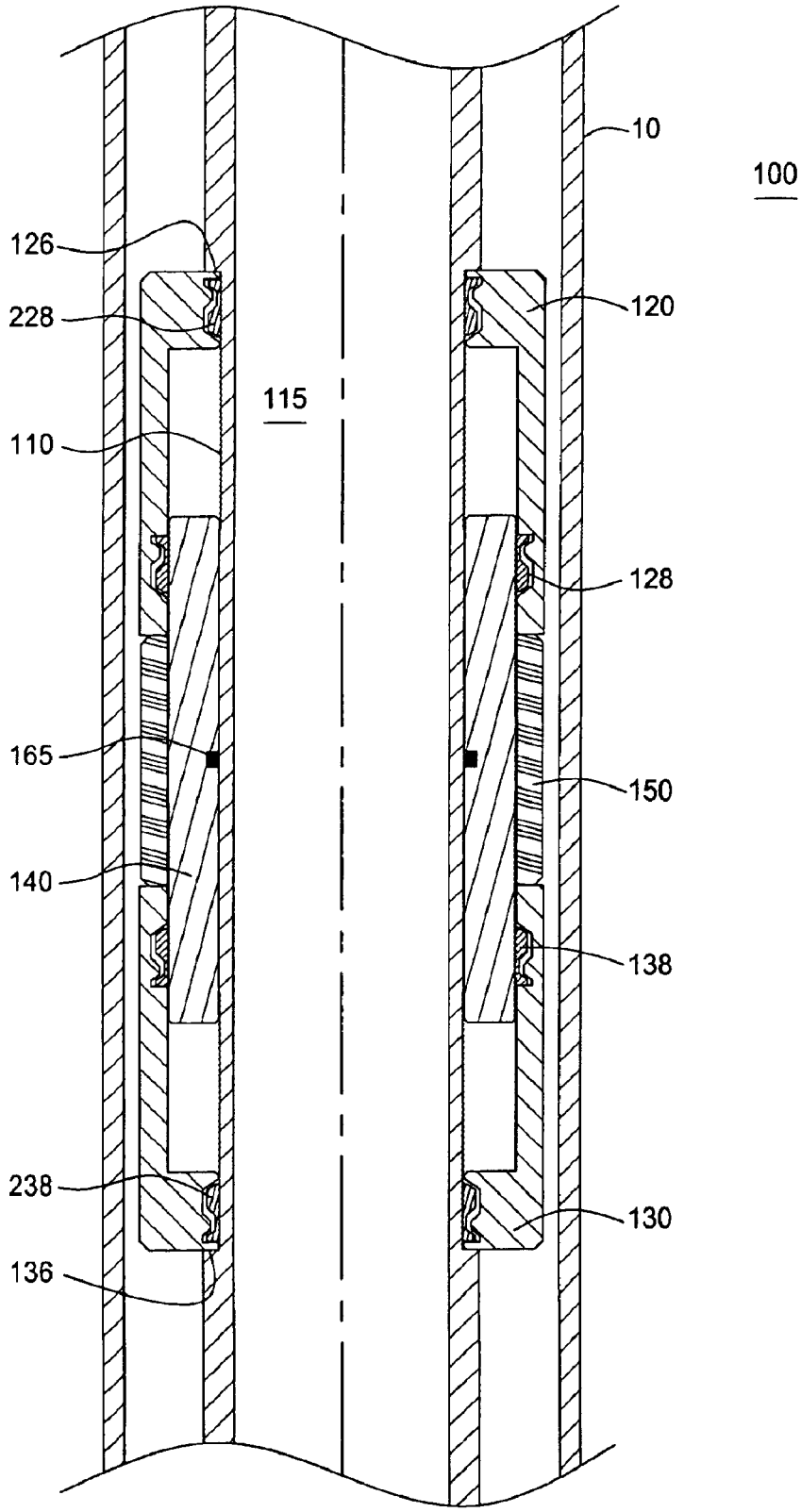
FIG. 2A presents a partial cross-sectional view of a packer assembly in accordance to another embodiment of the present invention in the unactuated position.

In another aspect of the present invention, shown in FIG. 2A, each of the top sleeve 120 and the bottom sleeve 130 is provided with a booster ratchet ring 128, 138 and a sleeve ratchet ring 228, 238 to limit the movement of the sleeves 120, 130, 140 relative to the mandrel 110. Top sleeve 120 has a sleeve ratchet ring 228 that engages the outer surface of the mandrel 110 and a booster ratchet ring 128 that engages the booster sleeve 140. Similarly, the bottom sleeve 130 has a sleeve ratchet ring 238 that engages the outer surface of the mandrel 110 and a booster ratchet ring 138 that engages the booster sleeve 140. The sleeve and booster ratchet rings 128, 138, 228, 238 are arranged to allow movement of the top and bottom sleeves 120, 130 toward the packer element 150 but not away from the packer element 150. Advantageously, the sleeve ratchet rings 228, 238 reduce the amount of movement between the booster sleeve 140 and the mandrel 110 during reversals in direction of the applied pressure. Furthermore, the sleeve ratchet rings 228, 238 also reduce the movement between the packer element 150 and the casing 10 during reversals in direction of applied pressure or when the applied pressure is reduced. This reduction in movement reduces wear of the packing element 150 and the seal 165 between the booster sleeve 140 and the mandrel 110, thereby increasing the life of the seal system.

Figure 2B:
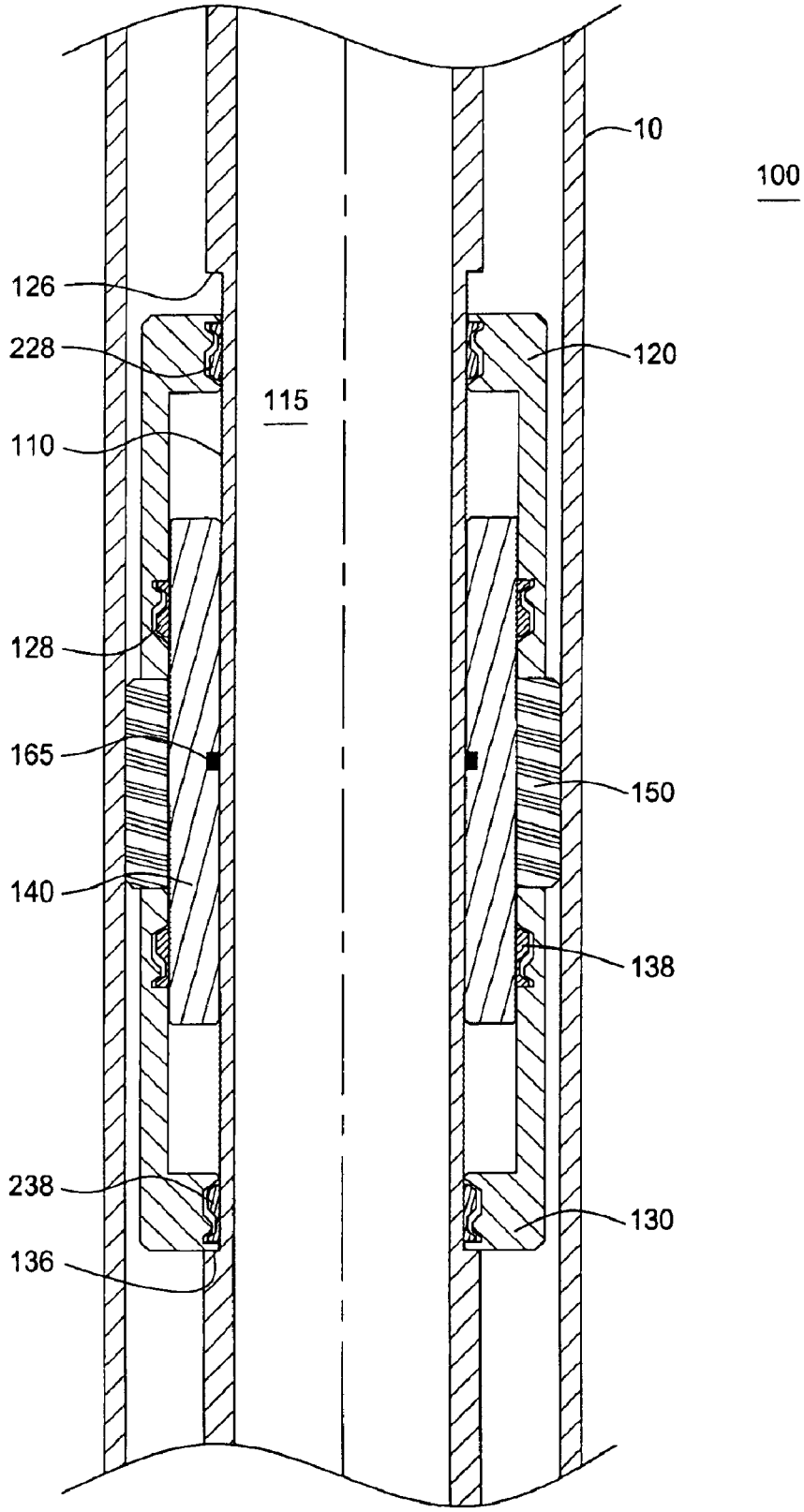
FIG. 2B presents the packer assembly in FIG. 2A in the actuated position.

To set the packer 100, a setting force is applied to the top sleeve 120. With the mandrel 110 held stationary, the top sleeve ratchet ring 228 and the top booster ratchet ring 128 permit the setting force to move the top sleeve 120 downward with respect to the mandrel 110. As shown in FIG. 2B, this moves the top sleeve 120 closer to the bottom sleeve 130, thereby compressing the packer element 150. In turn, the packer element 150 begins to expand radially to form a seal with the casing 10. The setting force creates an initial internal pressure in the packer element 150. As the top sleeve 120 moves towards the bottom sleeve 130, the booster ratchet ring 128 also moves along the booster sleeve 140 and prevents the top sleeve 120 from moving in the reverse direction relative to the booster sleeve 140. The top sleeve ratchet ring 228 also moves along the mandrel 110 and prevents the top sleeve 120 from moving in the reverse direction relative to the mandrel 110. Consequently, booster ratchet ring 128 helps to maintain the internal pressure in the packer element 150, and sleeve ratchet ring 228 helps to prevent relative movement between the element 150 and the mandrel 110.

After the packer element 150 is set, various forces may act on the packer 100 during the operation of the wellbore. When a pressure is applied from above to the booster sleeve 140 and the packer element 150, the force on the booster sleeve 140 is transferred to the top sleeve 120 through the one-way booster ratchet ring 128 engaging the booster sleeve 140. Because the packer element 150 is held stationary on the lower end by the bottom sleeve 130 resting against the lower shoulder 136, the downward force from the top sleeve 120 causes the packer element 150 to compress further. As the packer element 150 compresses, the booster sleeve 140 travels downward under the bottom sleeve 130. The booster ratchet ring 138 in the bottom sleeve 130 and the sleeve ratchet ring 228 in the top sleeve 120 lock in this movement and maintain a high level of internal pressure even after the applied pressure is reduced as shown in FIG. 2B.

Figure 2C:
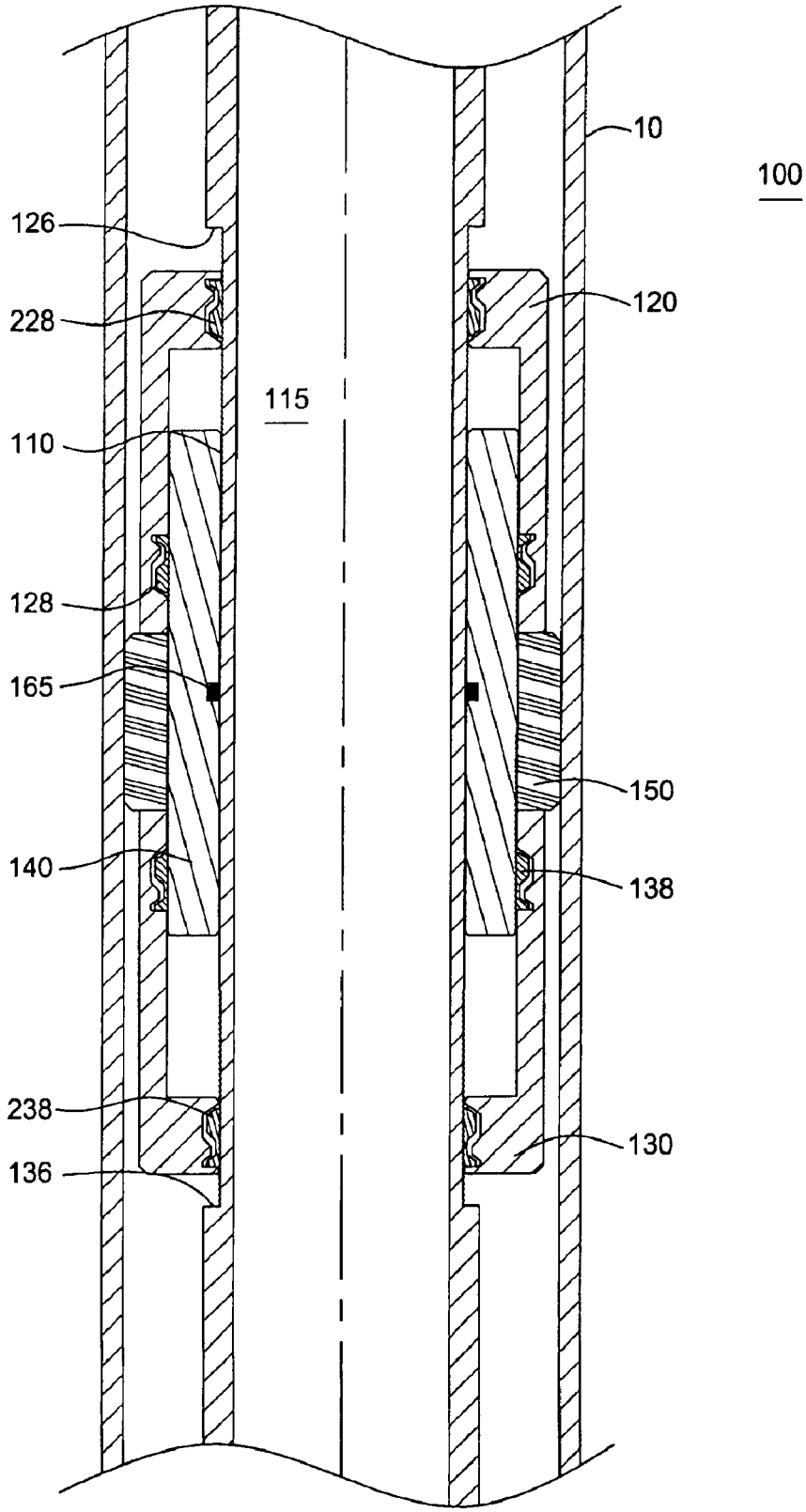
FIG. 2C presents the packer assembly in FIG. 2B after a pressure is applied from below.

FIG. 2C shows the packer 100 when pressure is applied from below after the packer element 150 is set. Pressure from below acts on the booster sleeve 140 which transfers the force to the bottom sleeve 130 through the booster ratchet ring 138 of the bottom sleeve 130. In turn, the bottom sleeve 130 moves toward the packer element 150 and exerts force on the packer element 150. However, the top sleeve 120 does not move relative to the mandrel 110 and the casing 10 due to the one-way sleeve ratchet ring 228 of the top sleeve 120. Because the top sleeve 120 is stationary, the packer element 150 begins to compress due to the force applied from the bottom sleeve 130. As the packer element 150 compresses, the booster sleeve 140 travels upward under the top sleeve 120. The booster ratchet ring 128 of the top sleeve 120 and the sleeve ratchet ring 238 of the bottom sleeve 130 lock in the movement of the booster sleeve 140 and maintain the internal pressure even after the applied pressure is reduced. As shown in FIG. 2C, both the top sleeve 120 and the bottom sleeve 130 are locked in a position on the mandrel 110 away from the shoulders 126,136.

Figure 3A:
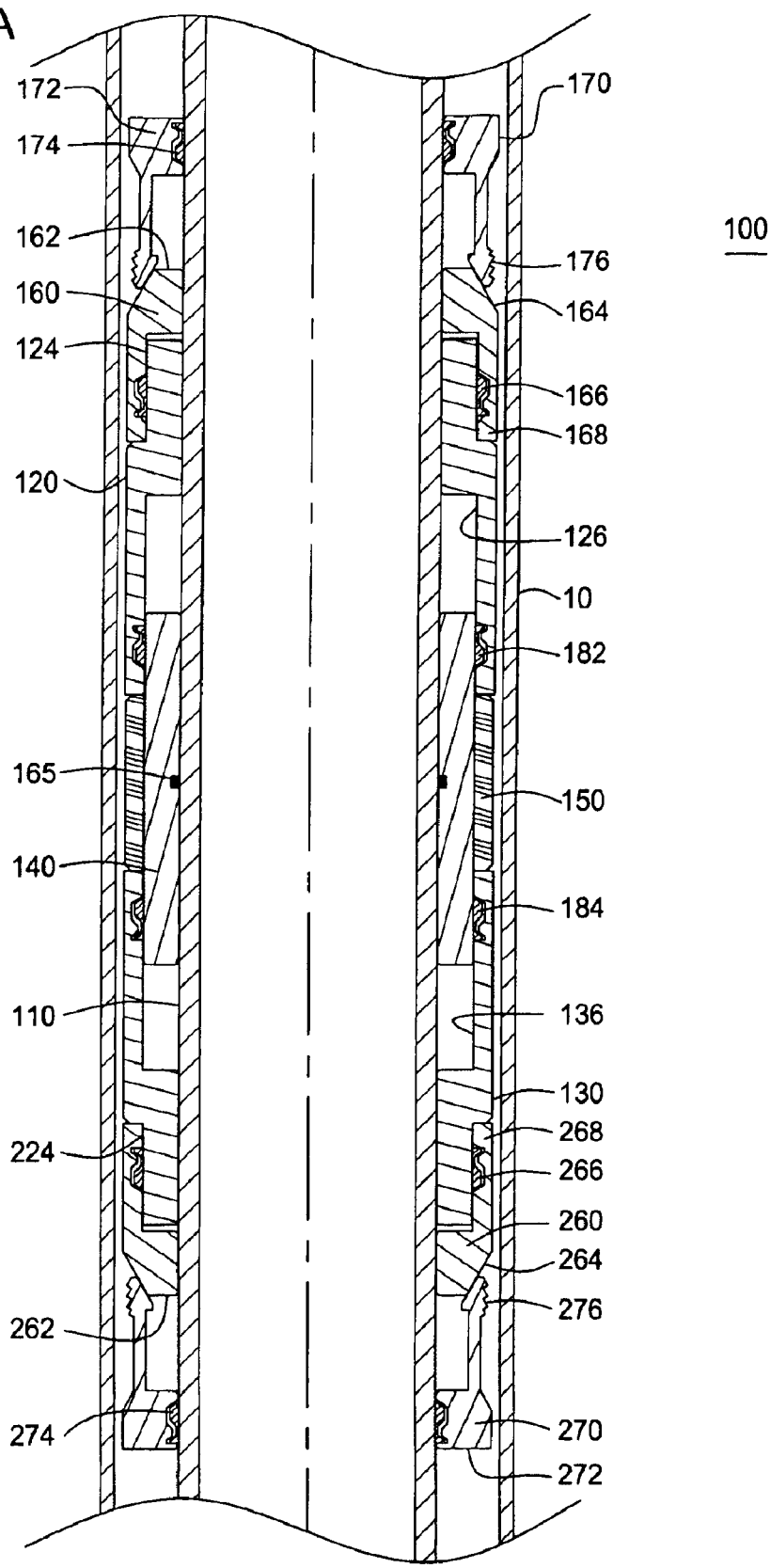
FIG. 3A presents a partial cross-sectional view of a packer assembly in accordance to another embodiment of the present invention in the unactuated position.

In another aspect, shown in FIG. 3A, the packer 100 of the present invention may include a slip 170, 270 and cone 160, 260 arrangement to transfer the axial load from the applied pressure acting on the booster sleeve 140 and the packer element 150 to the casing 10. Cones 160, 260 are disposed adjacent the top sleeve 120 and the bottom sleeve 130. Each cone 160, 260 is configured to have a proximal end 162, 262 and a distal end 164, 264. The wall thickness of each cone 160, 260 is greater at the distal end 164, 264 than at the proximal end 162, 262. In this way, a conical cross-section for each cone 160, 260 is provided. Each cone 160, 260 further includes an extension 168, 268 for engaging the outer surface of the corresponding top sleeve 120 or the bottom sleeve 130. The cones 160, 260 are equipped with a one-way cone ratchet ring 166, 266 to engage the corresponding sleeve 120, 130. Although only one cone 160, 260 is shown to be disposed proximate each sleeve 120, 130, the aspects of the present invention contemplate disposing one or more cones circumferentially around the outer surface of the mandrel 110.

Each cone 160, 260 has a corresponding set of slips 170, 270. Each slip 170, 270 is designed to ride upon the corresponding cone 160, 260 when the packer 100 is actuated. Movement of the slips 170, 270 may be accomplished by applying a mechanical or hydraulic force from the landing string. Upon actuation, the slips 170, 270 may move from the proximal end 162, 262 toward the distal end 164, 264 of the respective cone 160, 260, thereby extending radially outward to engage the surrounding casing 10.

Each slip 170, 270 has a base 172, 272 that serves as a circumferential connector to the individual slips. The slip base 172, 272 insures that all slips on the same side of the packer element 150 move axially together along the packer 100. Each base 172, 272 is provided with a slip ratchet ring 174, 274 to permit movement of the slips 170, 270 towards the packer element 150 but not away from it. This configuration allows axial forces in the mandrel 110 to be transferred through the slips 170, 270 and compress the packer element 150. The slip ratchet rings 174, 274 further serve to limit relative movement between the booster sleeve seal 165 and the mandrel 110 during pressure reversals, thereby increasing the life of the seal system.

In addition to a base 172, 272, each slip 170, 270 has a set of teeth, or wickers 176, 276, at a second end. The wickers 176, 276 provide a frictional surface for engaging the surrounding casing string 10. The wickers 176, 276 of each slip 170, 270 are associated with and ride upon cones 160, 260. Thus, actuation of the packer 100 includes movement of the wickers 176, 276 of slips 170, 270 along the associated cones 160, 260. In one embodiment, the slip 170, 270 may initially be selectively connected to the cone 160, 260 using a frangible member 190 as shown in FIG. 3E. The frangible member 190 serves to prevent premature actuation of the slip 170, 270 against the casing 10. Additionally, the frangible member 190 serves to transfer the force from the slip 170, 270 to the cone 160, 260 upon actuation.

Axial movement of the cone 160 causes the top sleeve 120 to compress against the packing element 150. To effectuate this, the top sleeve 120 is configured to have an upper shoulder portion 124 for engaging the extension 168 of the cone 160. The cone ratchet ring 166 only allows the top sleeve 120 to move toward the packer element 150. In this way, downward force applied against the cone 160 is transferred to the top sleeve 120. As a result, the full setting force may be initially applied against the top sleeve 120 so as to actuate the packing element 150. Advantageously, the cone ratchet ring 166 allows the booster sleeve 140 to move in the direction of the applied force so as to apply boost to the packer element 150 without pulling the cone 160 from the beneath the slips 170. The cone ratchet ring 166 also reduces the amount of movement between the packer element 150 and the casing 10 during reversals in direction of the applied pressure. Although the packer 100 is described as being set with a force applied from above, it is understood that force from below may be applied to act on the lower slip 270, cone 260, and sleeve 130 in a similar manner.

The top sleeve 120 has an extension member 126 that extends opposite the shoulder portion 124 and rides over the booster sleeve 140. The extension member 126 acts to apply downward force against the packing element 150. A booster ratchet ring 182 is disposed in the extension member 126 to engage the booster sleeve 140. The ratchet ring 182 is arranged so the top sleeve 120 may move in the direction toward the packing element 150 but not away from the packing element 150. It must be noted that the extension member 126 may take on various forms of profile for engaging the ratchet rings or other devices as is known to a person of ordinary skill in the art.

Opposite the top sleeve 120 is the bottom sleeve 130 that is identical to the top sleeve 120. The bottom sleeve 130 also has an extension member 136 that rides over the booster sleeve 140 to provide an upward compressive force against the packing element 150. A booster ratchet ring 184 is provided to limit the movement of the bottom sleeve 130 relative to the booster sleeve 140. The packing element 150 is compressed between the extension member 126 of the top sleeve 120 and the extension member 136 of the bottom sleeve 130. When the top sleeve 120 and the bottom sleeve 130 act against the packing element 150, the packing element 150 is expanded radially outward against the inner surface of the casing 10. In this way, the packing element 150 fills the annular region between the packer 100 and the casing 10 in order to provide a fluid seal. The bottom sleeve 130 further includes a shoulder 224 formed at the opposite end of the extension member 136 for engaging the lower slip 270 and cone 260 arrangement. The lower slip 270 and cone 260 arrangement is similar to the upper slip 170 and cone 160 arrangement and may be used to control the bottom sleeve 130.

Figure 3B:
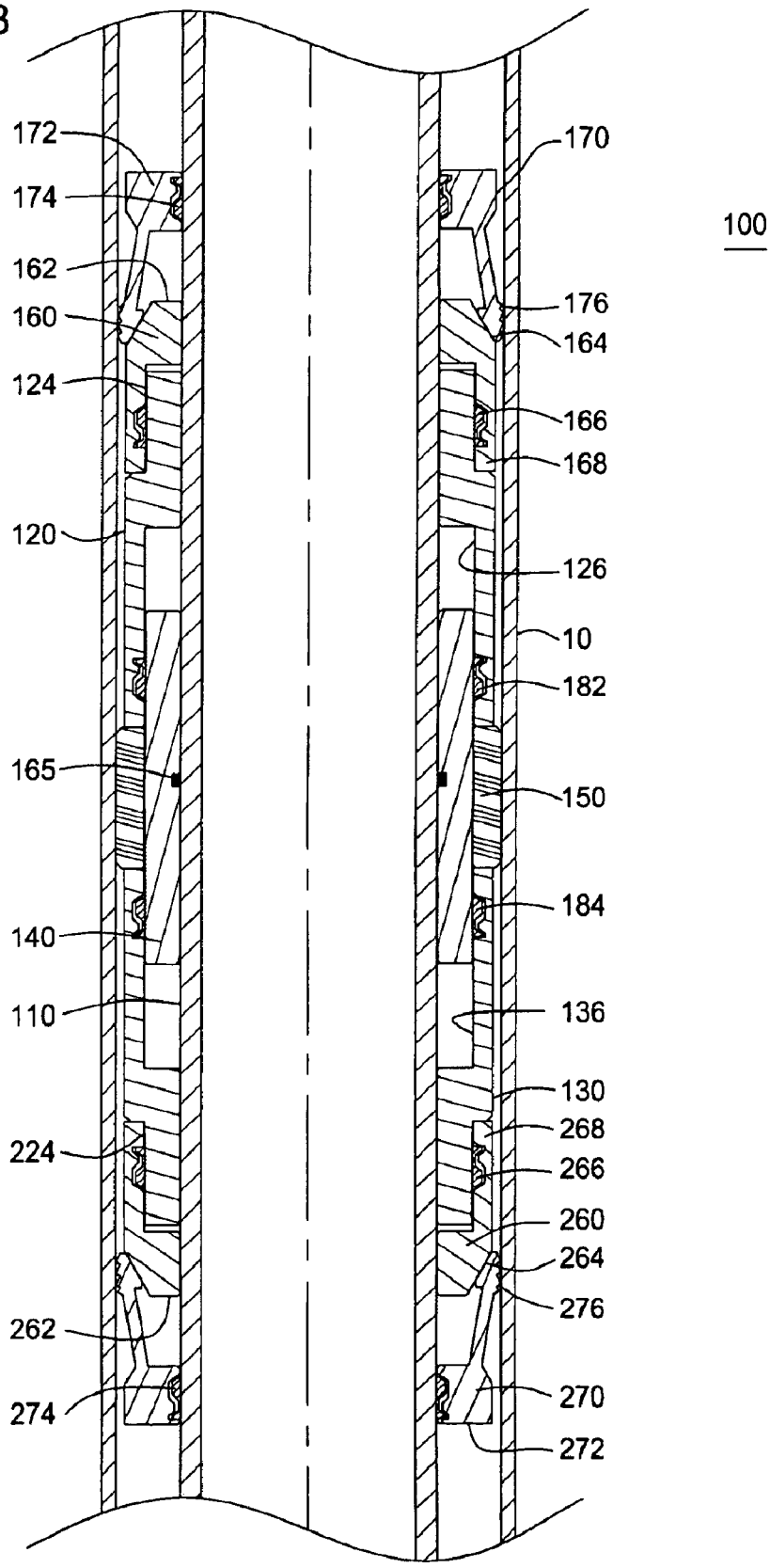
FIG. 3B–D presents the packer assembly in FIG. 3A in the actuated position.
Figure 3C:
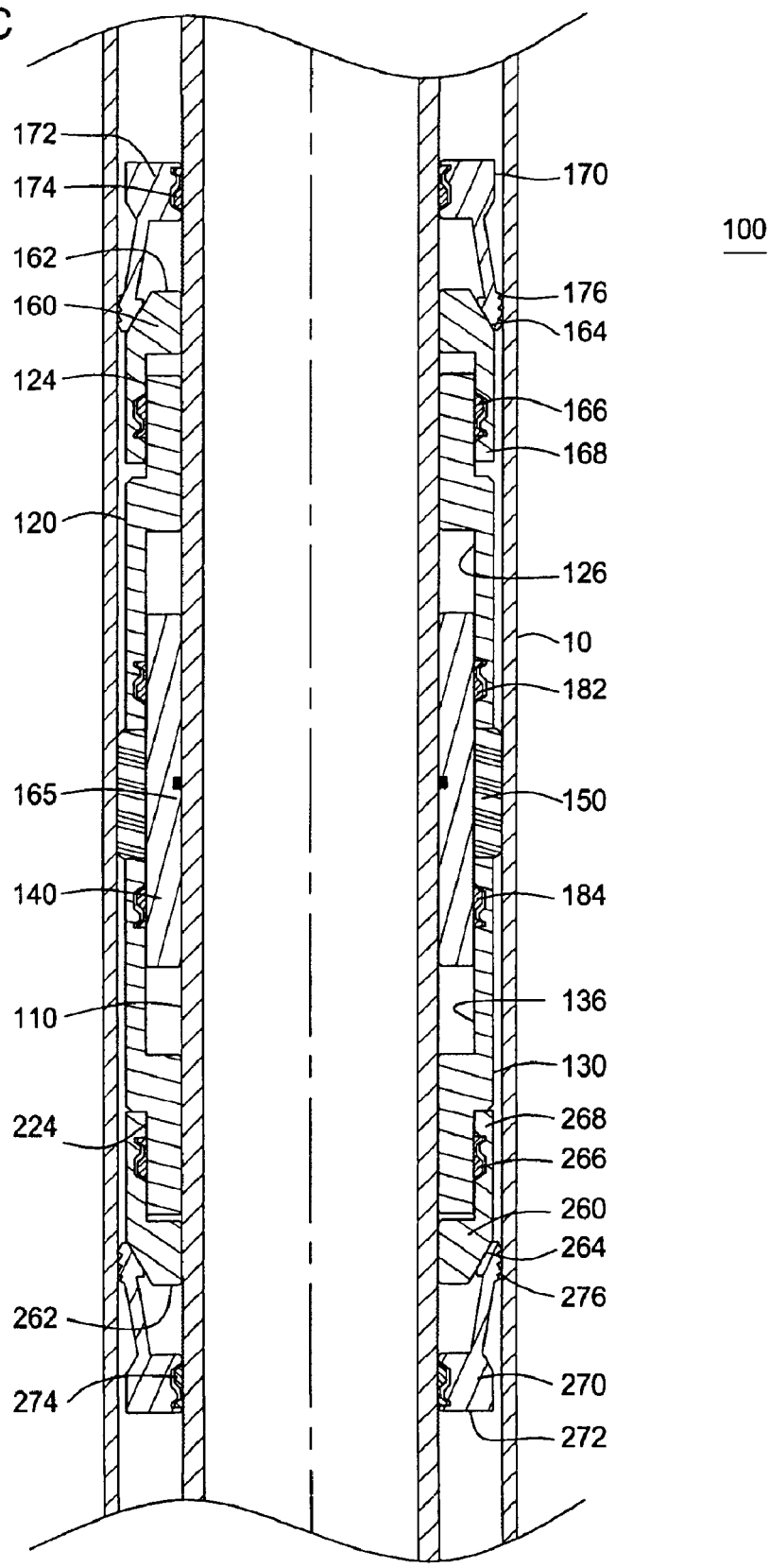
Figure 3D:
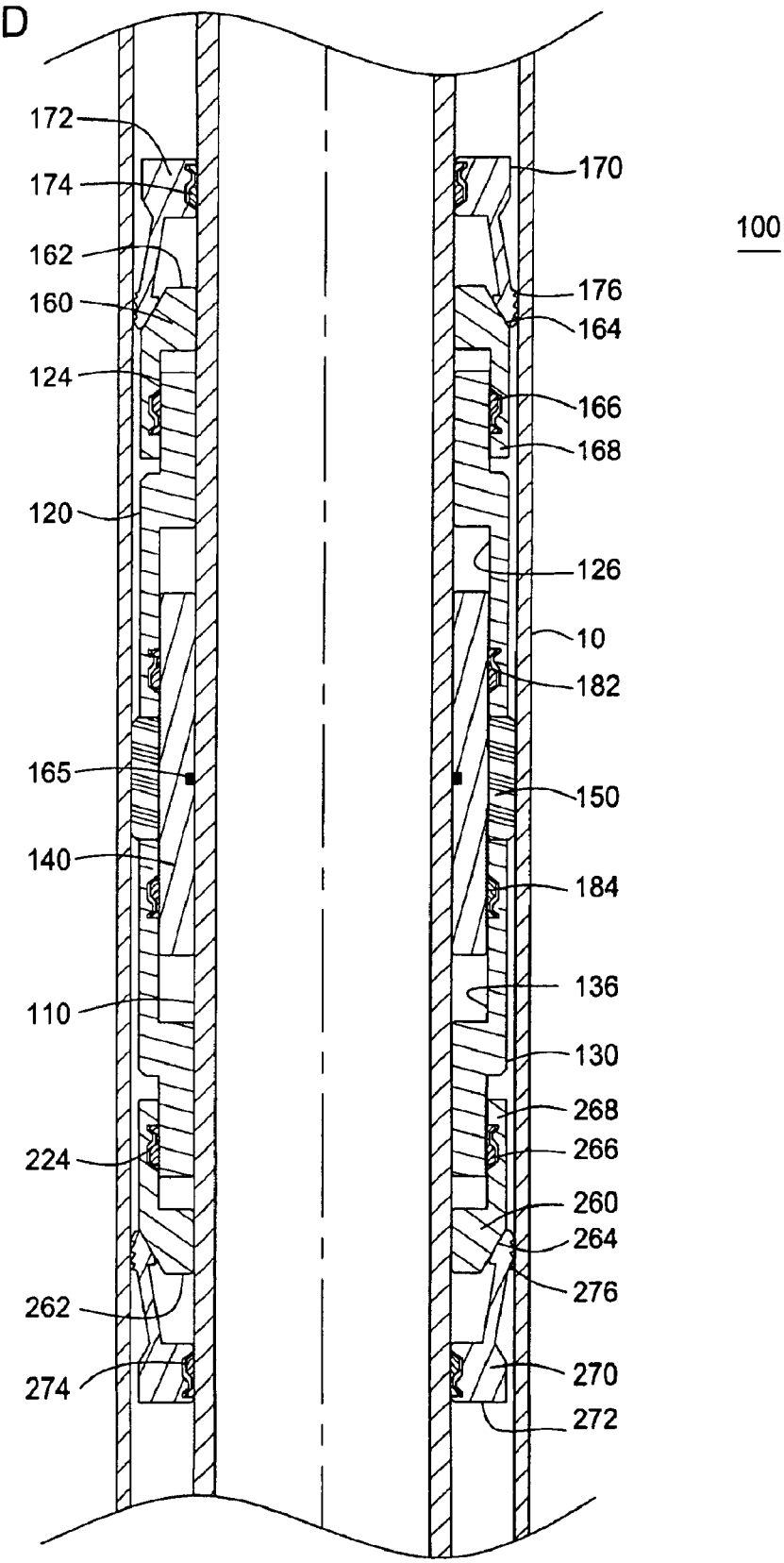
Figure 3E:
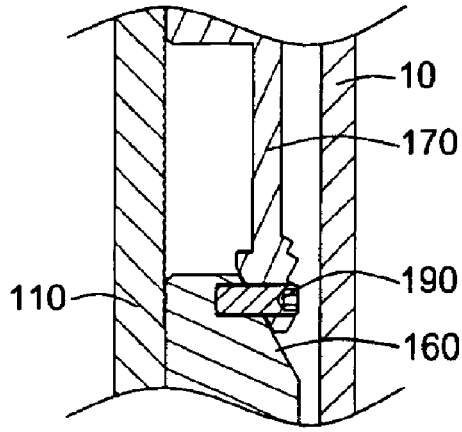
FIG. 3E illustrates an exploded view of a shearable member connecting the slip to the cone.

To set the packer 100, a setting force is downwardly applied to the upper slips 170 as shown in FIG. 3B. The slip ratchet ring 174 permits the slips 170 to move toward the packer element 150. The downward movement causes the slip 170 to push upon the cone 160. In turn, the top sleeve 120 compresses the packer element 150, thereby causing it to expand radially. The compressive force is transmitted through the lower sleeve 130 and lower cone 260 to drive the lower cone 260 under the lower slip 270, thereby causing the lower slip 270 to travel radially outward to engage the casing 10. The setting force creates an initial internal pressure in the packer element 150. At a predetermined force, the frangible member 190 connecting the slip 170 to the cone 160 is disengaged, thereby allowing the upper slips 170 to ride up the cone 160 and move out towards the casing 10. The ratchet rings 174, 166, 182 help to maintain the internal pressure in the packer element 150. Also shown in FIG. 3B, the wickers 276 of the lower slips 270 are engaged against the casing 10 and the cone 260 after the packer element 150 is set. FIG. 3C shows the movement of the top sleeve 120, booster sleeve 140, and packing element 150 reacting to differential pressure from above. FIG. 3D shows the movement of the bottom sleeve 130, booster sleeve 140, and packing element 150 reacting to differential pressure from below.

To accommodate the expansion-of the packing element 150, the element 150 may be fabricated from an extrudable material. Preferably, the extrudable material is an elastomeric substance. The substance is fabricated based upon design considerations including downhole pressures, downhole temperatures, and the fluid chemistry of the downhole fluids.

As a further aid to the sealing function of the packer 100, back up rings (not shown) may optionally be positioned above and below the packing element 150. The back up rings typically define C-rings, with two sets of rings being positioned above and below the packing element 150. The back up rings are commonly fabricated from a soft metal substance. The back up rings serve to maintain the packing element 150 in an axial position over the booster sleeve 140 after expansion against the casing 10.

Figure 3F:
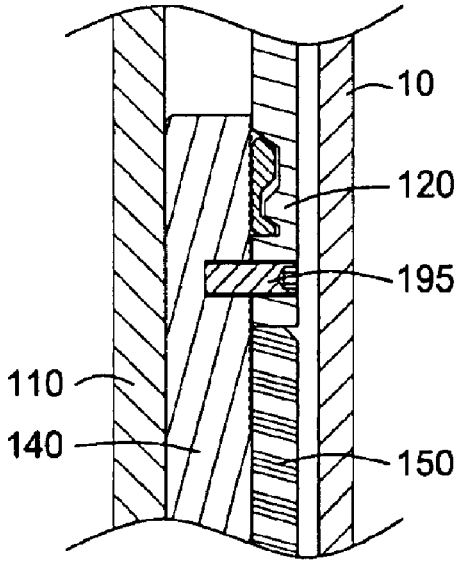
FIG. 3F illustrates an exploded view of a shearable member connecting the top sleeve to the booster sleeve.

In order to prevent premature actuation of the packing element 150 on the packer 100, various shearable members 195 may be optionally placed in the packer assembly 100. For example, a shear screw 195 may optionally be placed in the extension portion of the top sleeve 120 as shown in FIG. 3F. This top sleeve shear screw 195 selectively connects the top sleeve 120 to the booster sleeve 140. In this way, the top sleeve 120 is prevented from advancing across the booster sleeve 140 until a predetermined level of force is applied. Similarly, a shear screw may be positioned in the bottom sleeve 130 below the packing element 150. Additionally, shearable members may optionally be positioned between one or more slips 170, 270, cones 160, 260, sleeves 120, 130, mandrel 110, or any part in which premature movement is not desirable.

Additionally, the packer according to aspects of the present invention may be used in any downhole application requiring a packer between two co-axial tubulars and is not limited to liner top packers.

Additionally, the packer according to aspects of the present invention may be used alone or in conjunction with additional travel limiting devices such as ratchet rings, slips, and shoulders configured in several different ways. Other types of one-way travel limiting devices are also envisioned as is known to a person of ordinary skill in the art.

Additionally, the packer according to aspects of the present invention may be set by any method that can suitably apply force to it. Examples of setting methods include, but not limited to, mechanical, hydraulic, and hydrostatic.

Figure 4A:
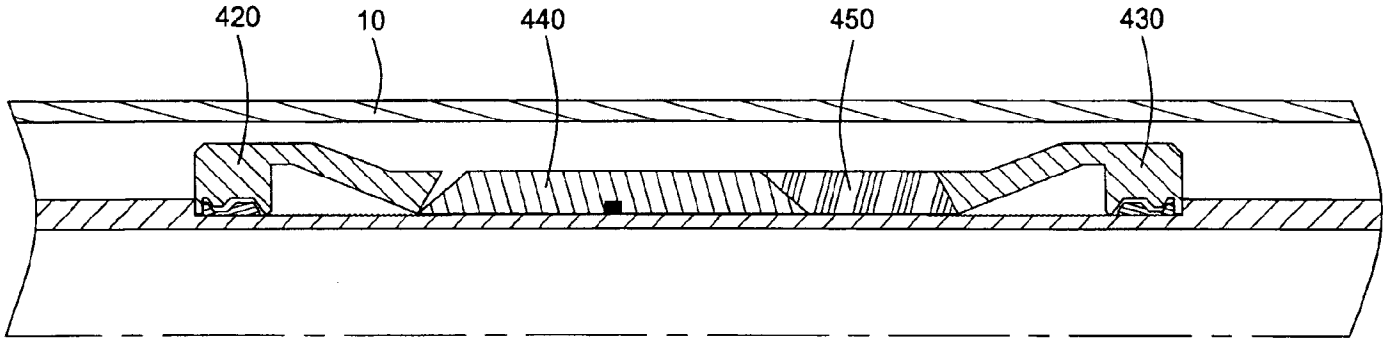
FIGS. 4A–B illustrate another embodiment of a packer assembly.
Figure 4B:
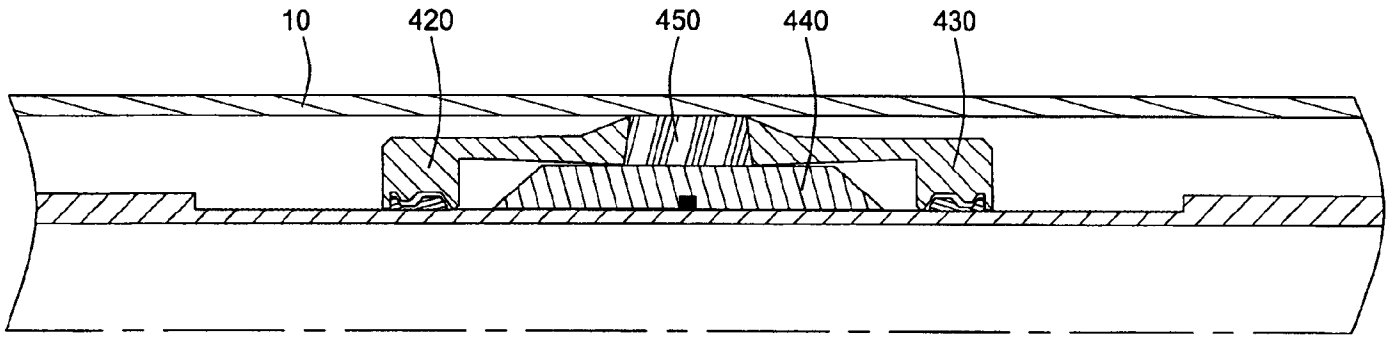

Additionally, the packing element is shown disposed on the booster sleeve during run-in. However, aspects of the invention contemplate placing the packing element adjacent the booster sleeve during run-in, as illustrated in FIGS. 4A–B. The packing element 450 and the booster sleeve 440 may be arranged so that the packing element 450 may slide across and above the booster sleeve 440 into the proper position for actuation. For example, the interface between the packing element 450 and the booster sleeve 440 may be angled to facilitate the movement of the packing element 450 onto the booster sleeve 440. In this embodiment, the extension members of the top and bottom sleeves 420, 430 may initially be used to push the packing element 450 onto the booster sleeve 440. Thereafter, the extension members may expand radially to contact the outer surface of the booster sleeve 440 and compress the packing element 450.

While the foregoing is directed to embodiments of the present invention, other and further embodiments of the invention may be devised without departing from the basic scope thereof, and the scope thereof is determined by the claims that follow.

What is claimed is:

1. A packer, comprising:

a mandrel having a first end and a second end;

a booster sleeve defining a tubular body having a first end and a second end, the booster sleeve being disposed circumferentially around the mandrel and sealingly engaged with the mandrel;

a packing element disposed circumferentially around an outer surface of the mandrel and adjacent the booster sleeve;

a first sleeve disposed on an outer surface of the mandrel, the first sleeve having an extension member disposed adjacent the booster sleeve for compressing the packing element;

a second sleeve disposed on the outer surface of the mandrel, the second sleeve having an extension member disposed adjacent to the packing element for compressing the packing element;

at least one motion limiting member disposed between the first sleeve and the booster sleeve that allows the first sleeve to move toward the packing element while preventing the first sleeve to move away from the packing element;

and at least one motion limiting member disposed between the second sleeve and the booster sleeve that allows the second sleeve to move toward the packing element while preventing the second sleeve to move away from the packing element, wherein the packing element is moved to the outer surface of the booster sleeve upon actuation of the packer.

2. A method of sealing a tubular in a wellbore, comprising:

placing a sealing apparatus in the tubular, the sealing apparatus comprising:

a booster sleeve disposed around a body;

a sealing member disposed around the booster sleeve; and an upper sleeve and lower sleeve disposed around the body;

applying a first fluid pressure to the upper sleeve;

radially expanding the sealing member by compressing the sealing member between the upper and lower sleeves in a first direction; and applying a second fluid pressure to the lower sleeve;

radially expanding the sealing member by compressing the sealing member between the upper and lower sleeves in a second direction.

3. The method of claim 2, wherein the first fluid pressure is applied from above the sealing apparatus to the booster sleeve.

4. The method of claim 3, further comprising transferring the first pressure force acting on the booster sleeve to the upper sleeve to further compress the sealing member.

5. The method of claim 4, further comprising moving the booster sleeve relative to the body toward the lower sleeve.

6. The method of claim 2, wherein the second fluid pressure is applied from below the sealing apparatus to the booster sleeve.

7. The method of claim 6, further comprising transferring the second pressure force acting on the booster sleeve to the lower sleeve to further compress the sealing member.

8. The method of claim 7, further comprising moving the booster sleeve relative to the body toward the upper sleeve.

9. The method claim 2, further comprising restricting movement of the upper and lower sleeves in a direction away from the sealing member.

10. The method claim 9, wherein at least one motion limiting member is used to restrict movement of the upper and lower sleeves.

11. An apparatus for use in a wellbore, comprising:

a mandrel;

a booster sleeve disposed around the mandrel;

a sealing member disposed around the booster sleeve;

an upper sleeve disposed around the mandrel adjacent an upper end of the sealing member, the upper sleeve designed to move closer to the booster sleeve and not away from the booster sleeve when a first hydraulic force is exerted on the upper sleeve; and a lower sleeve disposed around the mandrel adjacent a lower end of the sealing member, the lower sleeve designed to move closer to the booster sleeve and not away from the booster sleeve when a second hydraulic force is exerted on the lower sleeve.

12. The packer of claim 11, wherein movement of the upper and lower sleeves are limited by one or more motion limiting devices.

13. The packer of claim 12, wherein the one or more motion limiting devices limit movement of the upper and lower sleeves with respect to the booster sleeve.

14. The packer of claim 12, further comprising at least one motion limiting member disposed between the upper sleeve and the mandrel.

15. The packer of claim 11, further comprising a top conical member disposed above the upper sleeve and a bottom conical member disposed below the lower sleeve.

16. The packer of claim 14, further comprising a top slip member disposed above the top conical member and a bottom slip member disposed below the bottom conical member.

17. The packer of claim 16, wherein each of the slip members comprises a base and a gripping member.

18. The packer of claim 17, wherein the gripping member is extendable toward the tubular for engagement therewith.

19. The packer of claim 17, wherein the base comprises a motion limiting device.

20. The packer of claim 11, wherein the booster sleeve is movable relative to the mandrel.

21. The packer of claim 11, further comprising a seal disposed between the booster sleeve and the mandrel.

22. The packer of claim 11, wherein the upper, lower and booster sleeves are disposed between shoulders formed on the outer surface of the mandrel.

23. The packer of claim 12, wherein the at least one motion limiting device comprises a ratchet ring.

24. The packer of claim 11, wherein the upper sleeve has an extension member disposed adjacent to the packing element in order to apply the first force against the packing element.

25. The packer of claim 11, wherein the lower sleeve has an extension member disposed adjacent to the packing element in order to apply the second force against the packing element.

26. The packer of claim 11, further comprising first and second conical members circumferentially disposed on the mandrel.

27. The packer of claim 26, wherein the first conical member is disposed adjacent the first sleeve and the second conical member is disposed adjacent the second sleeve.

28. The packer of claim 27, wherein each of the conical members comprises a tapered outer surface and an elongated portion.

29. The packer of claim 28, wherein the elongated portion is movably attached to the respective sleeve.

30. The packer of claim 26, wherein each of the conical members is movably attached to the respective sleeve using at least one motion limiting member.

31. The packer of claim 26, further comprising one or more slip members circumferentially disposed on the mandrel.

32. The packer of claim 31, wherein the one or more slip members is disposed adjacent each of the first and second conical members.

33. The packer of claim 32, wherein the one or more slip members comprise a base and a gripping member.

34. The packer of claim 33, wherein the gripping member is movably connected to a tapered outer surface of the respective conical member.

35. The packer of claim 34, wherein the gripping member is selectively connected to the respective conical member using a shearable member.

36. The packer of claim 35, wherein the shearable member is designed to disengaged at a predetermined force.

37. The packer of claim 34, wherein the gripping member is designed to move along the tapered outer surface and engage a surrounding tubular.

38. The packer of claim 33, wherein the base comprises at least one motion limiting members.

39. The packer of claim 11, wherein the packer is actuated is using a force selected from the group consisting of mechanical, hydraulic, hydrostatic, and combinations thereof.

40. The packer of claim 11, wherein the booster sleeve is movable relative to the mandrel.

41. The packer of claim 11, wherein extension members at least partially extend along the outer surface of the booster sleeve.

42. A packer, comprising:

a mandrel having a first end and a second end;

a booster sleeve defining a tubular body having a first end and a second end, the booster sleeve being disposed circumferentially around the mandrel and sealingly engaged with the mandrel;

a packing element engaged with the mandrel and disposed circumferentially around an outer surface of the mandrel and adjacent the booster sleeve;

a first sleeve disposed on an outer surface of the mandrel, the first sleeve adapted to compress the packing element from a first direction; and a second sleeve disposed on the outer surface of the mandrel, the second sleeve adapted to compress the packing element from a second direction.

43. The packer of claim 42, wherein the first sleeve comprises an extension member disposed adjacent the booster sleeve for compressing the packing element.

44. The packer of claim 43, wherein the second sleeve comprises an extension member disposed adjacent to the packing element for compressing the packing element.

45. The packer of claim 42, wherein at least one motion limiting member is disposed between the first sleeve and the booster sleeve to allow the first sleeve to move toward the packing element while preventing the first sleeve to move away from the packing element.

46. The packer of claim 45, wherein at least one motion limiting member is disposed between the second sleeve and the booster sleeve to allow the second sleeve to move toward the packing element while preventing the second sleeve to move away from the packing element.

47. The packer of claim 42, wherein the packing element is moved to the outer surface of the booster sleeve upon actuation of the packer.

48. A packer, comprising:

a mandrel having a first end and a second end:

a booster sleeve defining a tubular body having a first end and a second end, the booster sleeve being disposed circumferentially around the mandrel and sealingly engaged with the mandrel;

a packing element disposed circumferentially around an outer surface of the booster sleeve;

a first sleeve disposed on an outer surface of the mandrel adjacent the first end of the booster sleeve, the first sleeve having an extension member disposed adjacent to the packing element in order to apply a first force against the packing element;

a second sleeve disposed on the outer surface of the mandrel adjacent the second end of the booster sleeve, the second sleeve having an extension member disposed adjacent to the packing element in order to apply a second force against the packing element;

a first motion limiting member disposed between the first sleeve and the booster sleeve that allows the first sleeve to move toward the packing element while preventing the first sleeve to move away from the packing element;

a second motion limiting member disposed between the second sleeve and the booster sleeve that allows the second sleeve to move toward the packing element while preventing the second sleeve to move away from the packing element; and first and second conical members circumferentially disposed on the mandrel;

wherein each of the conical members is movably attached to the respective sleeve using at least one motion limiting member.

49. A packer having a bi-directionally boosted and trapped packing element, the packer designed to engage a surrounding tubular, the packer comprising:

a mandrel having a top end and a bottom end;

a booster sleeve having a top end and a bottom end, the booster sleeve being disposed circumferentially around the mandrel;

a seal disposed between the boaster sleeve and the mandrel;

a packing element disposed circumferentially around an outer surface of the booster sleeve;

a top sleeve disposed on the outer surface of the mandrel above the booster sleeve, the top sleeve having an extension member disposed above the packing element in order to apply a downward force against the packing element;

a bottom sleeve disposed on the outer surface of the mandrel below the booster sleeve, the bottom sleeve having an extension member disposed below the packing element in order to apply an upward force against the packing element, wherein the top and bottom sleeves are designed to move closer to the booster sleeve and not away from the booster sleeve;

a top conical member disposed above the top sleeve and a bottom conical member disposed below the bottom sleeve; and a top slip member disposed above the top conical member and a bottom slip member disposed below the bottom conical member;

wherein each of the slip members comprises a base and a gripping member, and wherein the base comprises a motion limiting device.

* * * * *